US006587823B1

(12) United States Patent
Kang et al.

(10) Patent No.: US 6,587,823 B1
(45) Date of Patent: Jul. 1, 2003

(54) DATA CODEC SYSTEM FOR COMPUTER

(75) Inventors: Kyeong Ok Kang, Taejon (KR); Dae Young Jang, Taejon (KR); Jin Suk Kwak, Taejon (KR); Jin Woo Hong, Taejon (KR); Sung Han Kim, Taejon (KR); Young Kwon Lim, Taejon (KR); Jin Woong Kim, Taejon (KR); Harald Popp, Tuchenbach (DE); Stefan Geyersberger, Wuerzburg (DE); Wolfgang Fiesel, Schwanstetten (DE)

(73) Assignee: Electronics and Telecommunication Research & Fraunhofer-Gesellschaft, Munich (DE)

( * ) Notice: Subject to any disclaimer, the term of this patent is extended or adjusted under 35 U.S.C. 154(b) by 0 days.

(21) Appl. No.: 09/456,421

(22) Filed: Dec. 8, 1999

(30) Foreign Application Priority Data

Jun. 29, 1999 (KR) ..... 99-25472

(51) Int. Cl.[7] ..... G10L 21/00

(52) U.S. Cl. ..... 704/275; 704/231; 704/246; 704/270; 370/260; 370/376; 370/442

(58) Field of Search ..... 704/270–275, 704/246, 231, 273; 370/260, 376, 442

(56) References Cited

U.S. PATENT DOCUMENTS 5,274,758 A 12/1993 Beitel et al. ..... 395/154
5,506,954 A 4/1996 Arshi et al. ..... 395/162
5,519,640 A * 5/1996 Ganesan et al. ..... 709/231
5,553,220 A * 9/1996 Keene ..... 345/520
5,732,224 A 3/1998 Gullick et al. ..... 395/280
5,799,091 A * 8/1998 Lodenius ..... 375/295
5,841,763 A * 11/1998 Leondires et al. ..... 348/14.08
5,875,037 A * 2/1999 Murata et al. ..... 358/400
5,910,180 A * 6/1999 Flory et al. ..... 703/21
5,937,057 A * 8/1999 Bell et al. ..... 348/14.11
5,974,471 A * 10/1999 Belt ..... 709/247
5,983,183 A * 11/1999 Tabet et al. ..... 381/108
5,999,985 A * 12/1999 Sebestyen ..... 370/465
6,009,476 A * 12/1999 Flory et al. ..... 709/324

OTHER PUBLICATIONS

"Accelerating Multimedia With Enhanced Microprocessors", by Ruby B. Lee, appearing in IEEE Micro, Apr. 1995, pp. 22–32 (0272–1732/95) ©1995.

"An Implementation of Control Protocol for Multipoint Audio–Video Teleconferencing Systems", by Kyung Hee Lee, et al, appearing in IEEE, pp. 38–41, ©1998 (0–8186–7225–0/98).

Multimedia LSI Accelerator With Embedded DRAM, by Ichiro Sase et al, appearing in IEEE Micro, Nov./Dec. 1997, p. 49–54, ©1997 (0272–1732/97).

* cited by examiner

*Primary Examiner*—Vijay Chawan
(74) *Attorney, Agent, or Firm*—Antonelli, Terry, Stout & Kraus, LLP

(57) ABSTRACT

The present invention relates to a data CODEC system for computer. The data CODEC system for computer comprises a system control software, a multichannel audio/speech and multimedia data signal processor, and a multichannel audio/speech and multimedia data input-output unit. The system control software communicates multichannel audio/speech and multimedia data with the multichannel audio/speech and multimedia data signal processor according to control of various application programs. The multichannel audio/speech and multimedia data signal processor processes multichannel audio/speech and multimedia data. The multichannel audio/speech and multimedia data input-output means inputs/outputs multichannel audio/speech and multimedia data from/to an external system.

20 Claims, 8 Drawing Sheets

DATA CODEC SYSTEM FOR COMPUTER

BACKGROUND OF THE INVENTION

1. Field of the Invention

The present invention relates to a data CODEC system for computer, particularly to a CODEC mounted to a personal computer (PC), for performing various digital signal processes, such as compression or reconstruction of multichannel audio/speech or multimedia data, and more particularly to a PC-based multichannel audio/speech and data CODEC system having an acceleration function for processing multimedia data and a function of inputting or outputting multichannel audio/speech from or to an external system.

2. Description of Related Art

Functions of existing computer audio processing systems are limited to a stereo-audio process and the existing systems have only functions of inputting and outputting stereo/mono audio/speech signals and simple compression and reconstruction functions. Consequently, the existing computer audio processing systems cannot provide means for input and playback of high quality multichannel audio.

Although an existing multichannel audio input-output system is provided with multichannel audio, it just provides simple input-output functions such as record and playback or is used as an expensive independent system supporting special functions. Therefore, it is a system for professional experts, so it is used by a few particular users as needed.

Recently, users demands for multimedia service and multimedia are increasing and such service has been rapidly spread out via an internet. For example, the internet is providing transmission of high quality audio/video on demand, video conference between multiple points, and home shopping.

As the PC has been used in more and more fields, it has needed for the PC to process various multimedia data. However, conventional technology substantially has limitation, so it is urgently required to develop technology for enhancing efficiency of the present PC.

SUMMARY OF THE INVENTION

Accordingly, the present invention is directed to a PC-based multichannel audio/speech and data CODEC system having acceleration and input-output functions for multimedia data processing that substantially obviates one or more of the limitations and disadvantages of the related art.

An objective of the present invention is to provide a PC-based multichannel audio/speech and data CODEC system mounted to a PC, which has functions of communicating various data with storage media in the PC, performing various multimedia processing by controlling the system with system control software which executes load of application programs via the storage media of the PC, exchange of system control data and status information, and transmission of audio, speech, and multimedia data, and acceleration for compression and reconstruction of multichannel audio, speech, and multimedia data at high speed or in real time with the aid of an internal high performance digital signal processor (DSP) engine, as well as a function of inputting and outputting multichannel audio, speech, and data from or to an external system.

Additional features and advantages of the invention will be set forth in the description which follows, and in part will be apparent from the description, or may be learned by practice of the invention. The objectives and other advantages of the invention will be realized and attained by the structure as illustrated in the written description and claims hereof, as well as the appended drawings.

To achieve these and other advantages, and in accordance with the purpose of the present invention as embodied and broadly described, a PC-based multichannel audio/speech and data CODEC system comprises: system control software for communicating multichannel audio/speech and data with multichannel audio/speech and data signal processing means according to control of various PC application programs; a multichannel audio/speech and data signal processing section for processing multichannel audio/speech and data using application programs according to control of the system control software; and a multichannel audio/speech and data input-output section for inputting or outputting multichannel audio/speech and multimedia data from or to an external system.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENT

Reference will now be made in detail to the preferred embodiments of the present invention, examples of which are illustrated in the accompanying drawings.

With reference to the accompanying drawings, the present invention will now be described in detail.

Figure 1:
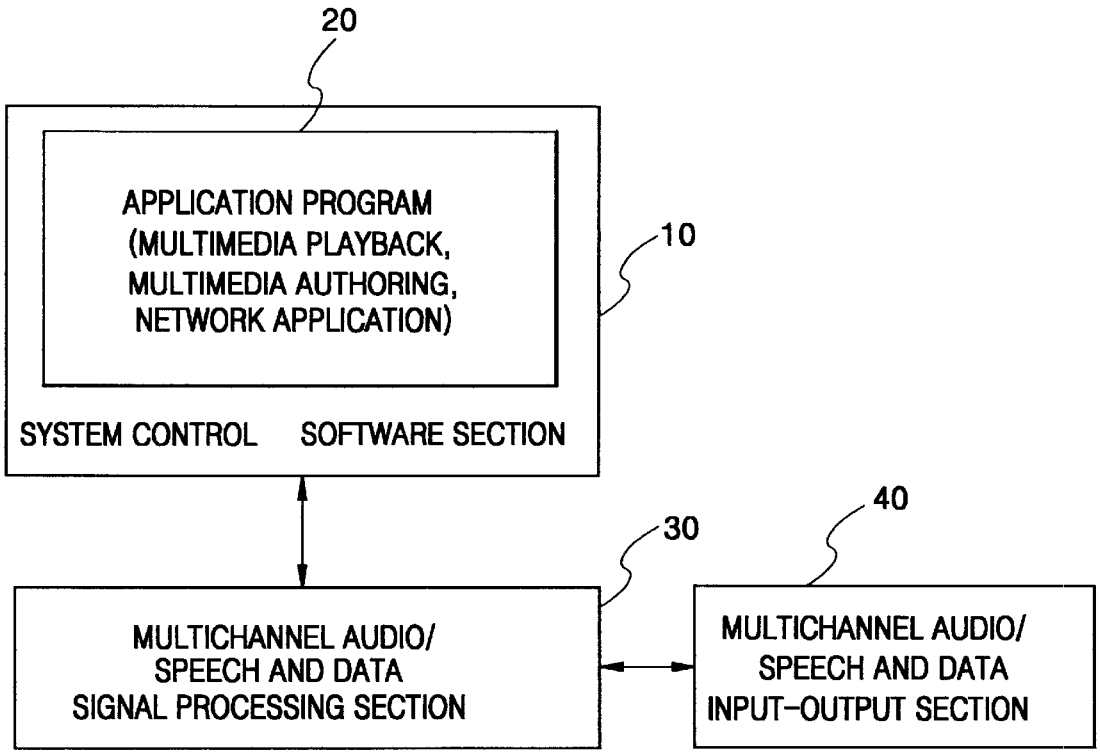
FIG. 1 illustrates a configuration of a data CODEC system for computer according to the present invention.

FIG. 1 illustrates a configuration of a PC-based multichannel audio/speech and data CODEC system according to the present invention. As shown in FIG. 1, the CODEC system comprises: system control software section 10 for supporting processes of multichannel audio/speech and data signals by the control of various application programs 20; multichannel audio/speech and data signal processing section 30 for communicating multichannel audio/speech and data with system control software section 10 and processing the multichannel audio/speech and data based upon the application programs; and multichannel audio/speech and data input-output section 40 for inputting or outputting the multichannel audio/speech and data from or to an external system.

The PC multichannel audio/speech and data CODEC system of the present invention not only has functions of externally inputting and outputting multichannel audio/speech and data but also communicates various data with storage media of a PC after mounted to the PC. The CODEC system can also perform various multimedia processing functions by controlling the system with system control software which executes load of the application programs from the PC storage media, communication of system control data and status information, and transmission of audio/speech and multimedia data. Additionally, this CODEC system has an internal high performance DSP engine, so that it can be provided with an acceleration function for compression and reconstruction of multichannel audio, speech, and multimedia data at high speed or in real time. The PC multichannel audio/speech and data CODEC system will be described in detail with reference to FIGS. 2 to 4 respectively illustrating the system control software section, the multichannel audio/speech and data signal processing section, and the multichannel audio/speech and data input-output section.

Figure 2:
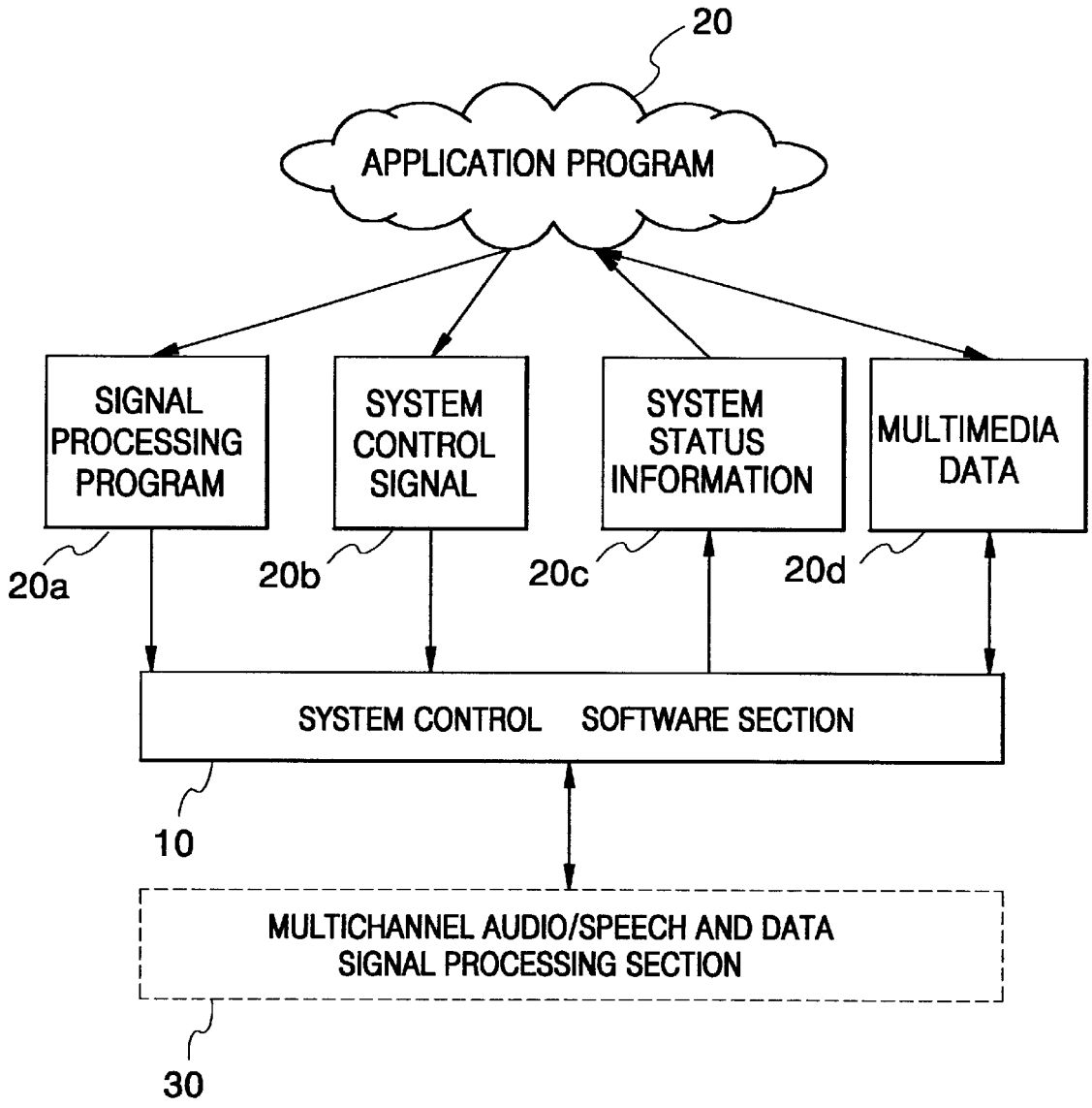
FIG. 2 shows functions of a system control software section depicted in FIG. 1.

FIG. 2 is a block diagram showing functions of the system control software section depicted in FIG. 1. System control software section 10 between PC application program 20 and multichannel audio/speech and data signal processing section 30 loads signal processing program 20*a,* which is a PC application program related to playback and authoring of multimedia data and network application, onto multichannel audio/speech and data signal processing section 30 using graphic user interface (not shown).

System control software section 10 also transmits to multichannel audio/speech and data signal processing section 30, system control signal 20*b* for activating multichannel audio/speech and data signal processing section 30 and multichannel audio/speech and data input-output section 40. System control software section 10 transmits to application program 20, system status information 20*c* of multichannel audio/speech and data signal processing section 30 and multichannel audio/speech and data input-output section 40, or performs necessary actions. System control software section 10 transmits multimedia data 20*d* such as multichannel audio/speech or other data to multichannel audio/speech and data signal processing section 30 or transmits result data of multichannel audio/speech and data signal processing section 30 to application program 20.

Figure 3:
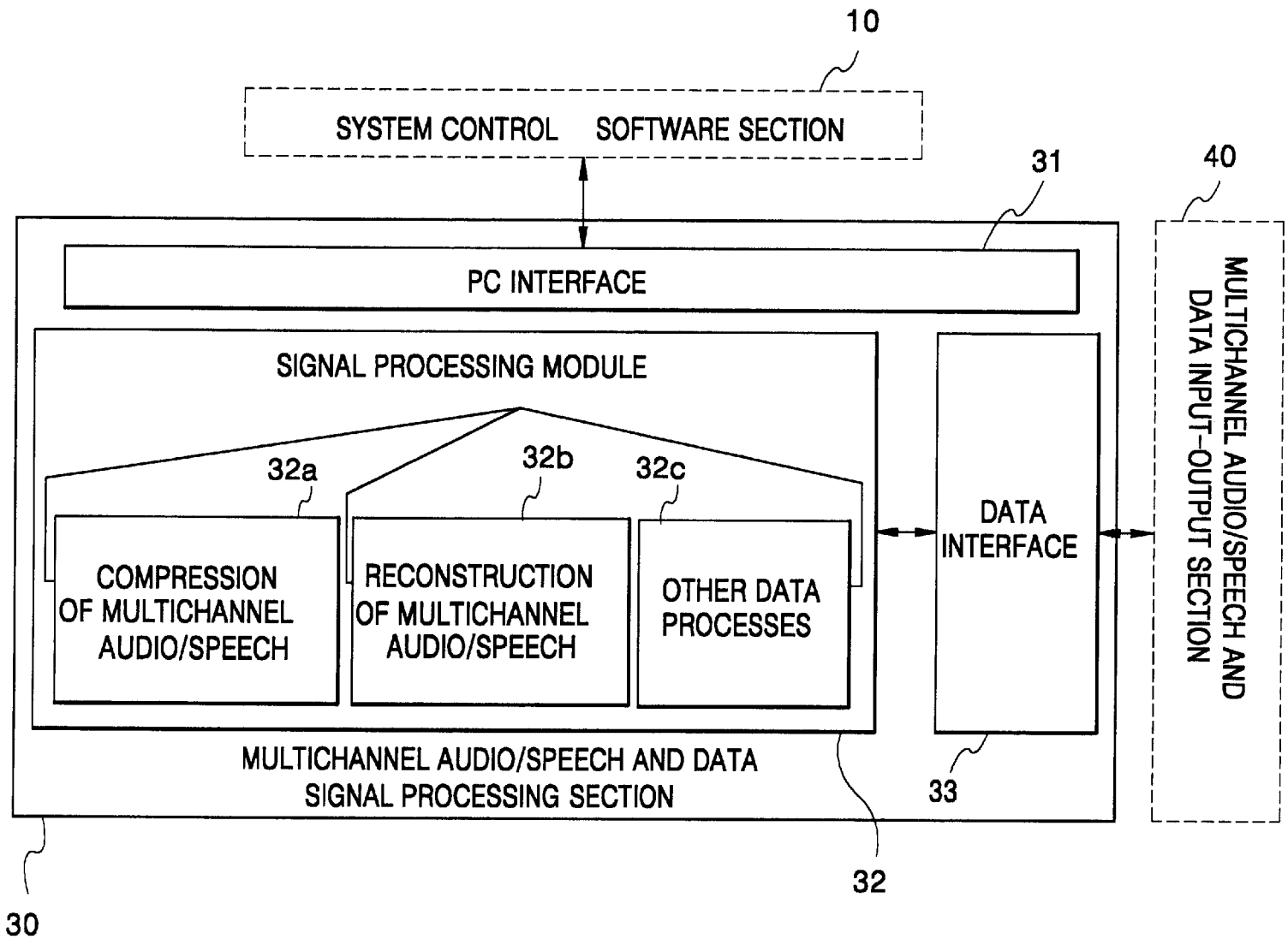
FIG. 3 shows a multichannel audio/speech and data signal processing section depicted in FIG. 1.

FIG. 3 is a block diagram showing the multichannel audio/speech and data signal processing section depicted in FIG. 1. Multichannel audio/speech and data signal processing section 30 receives multichannel audio/speech and multimedia data from application program 20 in the PC storage media through PC interface 31 according to the system control signal and graphic user interface of system control software section 10 or receives external system (not shown) originated multichannel audio/speech and multimedia data from multichannel audio/speech and data input-output section 40 via data interface 33 and executes the signal processing program loaded onto signal processing module 32 via PC interface 31 from application program 20 by the control of system control software section 10.

Signal processing module 32 is a module for signal processing multichannel audio/speech and data and can be embodied with a general-purpose digital signal processor. Signal processing module 32 has an acceleration function for compression of multichannel audio/speech (32*a*), reconstruction of multichannel audio/speech (32*b*), and other data processes (32*c*) such as multimedia data compression and reconstruction and a sound effect process. Signal processing module 32 transmits result data of processes to PC application program 20 via PC interface 31 to store it in the PC storage media or sends the data to multichannel audio/speech and data input-output section 40 via data interface 33 so as for the data to be transmitted to the external system.

Figure 4:
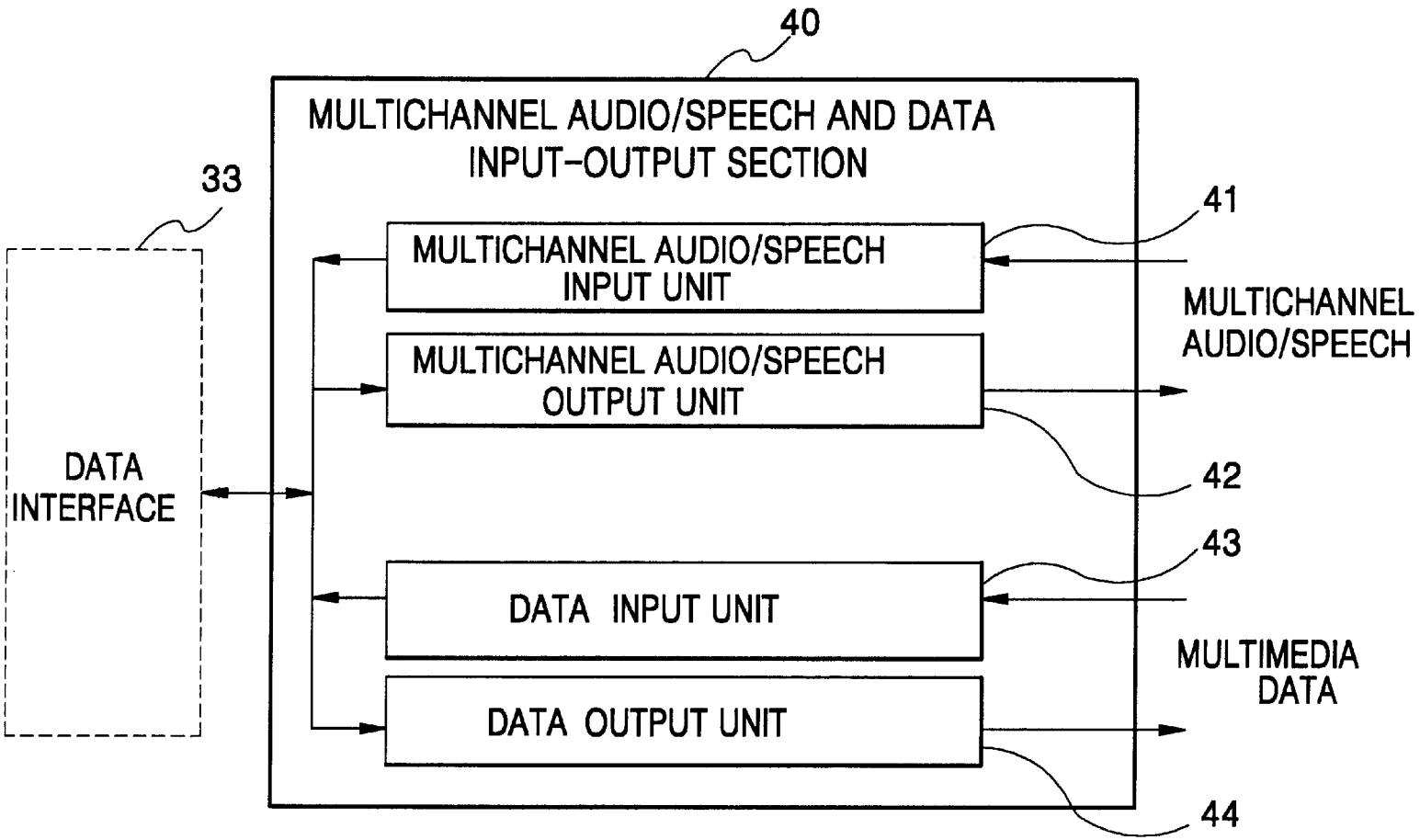
FIG. 4 shows a multichannel audio/speech and data input-output section depicted in FIG. 1.

FIG. 4 is a block diagram showing the multichannel audio/speech and data input-output section depicted in FIG. 1. Multichannel audio/speech and data input-output section 40 receives the data which has been processed at multichannel audio/speech and data signal processing section 30 via data interface 33. When the processed data is multichannel audio/speech, multichannel audio/speech and data input-output section 40 sends the data to the external system via multichannel audio/speech output unit 42. When the processed data is other multimedia data, multichannel audio/speech and data input-output section 40 sends the data to the external system via data output unit 44. When multichannel audio/speech is inputted from the external system, multichannel audio/speech and data input-output section 40 receives the data via multichannel audio/speech input unit 41. Or when other multimedia data is inputted from the external system, multichannel audio/speech and data input-output section 40 receives the data via data input unit 43. Then, multichannel audio/speech and data input-output section 40 transmits the data to multichannel audio/speech and data signal processing section 30 via data interface 33. Operations of input and output of multichannel audio/speech uses a standard digital audio format or analog format. In the multimedia data input and output operations, packetized serial data is inputted or outputted from or to the external system. Multichannel audio/speech and data input-output section 40 also has functions of restoring clocks and establishing a clock mode for synchronization of the input and output units.

An exemplary operation of the present invention will now be described with respect to the signal processing of multichannel audio and/or speech.

Primarily, multichannel audio/speech and data signal processing section 30 shown in FIG. 3 may operate in an encoding mode or decoding mode according to control of system control software section 10. When multichannel audio/speech and data signal processing section 30 operates in the encoding mode according to the control of system control software section 10 using the graphic user interface, multichannel audio/speech and data signal processing section 30 executes a signal processing program related to encoding of multichannel audio and/or speech, the signal processing program being loaded onto signal processing module 32 via PC interface 31 from PC application program 20. When the data to be encoded is multichannel audio/speech via PC interface 31 from the application program 20 in the PC storage media, signal processing module 32 executes the signal processing related to the encoding and sends the encoded multichannel audio/speech signals to the PC application program via PC interface 31, to store the data in the PC storage media, or sends the data to multichannel audio/speech and data input-output section 40, to transmit the data to the external system via multichannel audio/speech output unit 42, according to the system control signal of system control software section 10.

When the data to be encoded is originated from the external system via multichannel audio/speech and data input-output section 40 and data interface 33, multichannel audio/speech and data signal processing section 30 performs the same signal processing procedure as the data is from the fixed PC storage media.

Alternatively, when multichannel audio/speech and data signal processing section 30 operates in the decoding mode according to the control of system control software section 10 using the graphic user interface, multichannel audio/speech and data signal processing section 30 executes a signal processing program related to decoding of multichannel audio and/ or speech, the signal processing program being loaded onto signal processing module 32 via PC interface 31 from PC application program 20. When the data to be decoded is the multichannel audio/speech via PC interface 31 from the application program 20 in the PC storage media, signal processing module 32 executes the signal processing related to the decoding and sends the decoded multichannel audio/speech signals to the PC application program 20 via PC interface 31, to store the data in the PC storage media, or sends the data to multichannel audio/speech and data input-output section 40, to transmit the data to the external system via multichannel audio/speech output unit 42, according to the system control signal of system control software section 10. When the data to be decoded is originated from the external system via multichannel audio/speech and data input-output section 40 and data interface 33, multichannel audio/speech and data signal processing section 30 performs the same signal processing procedure as the data is from the PC storage media.

Figure 5:
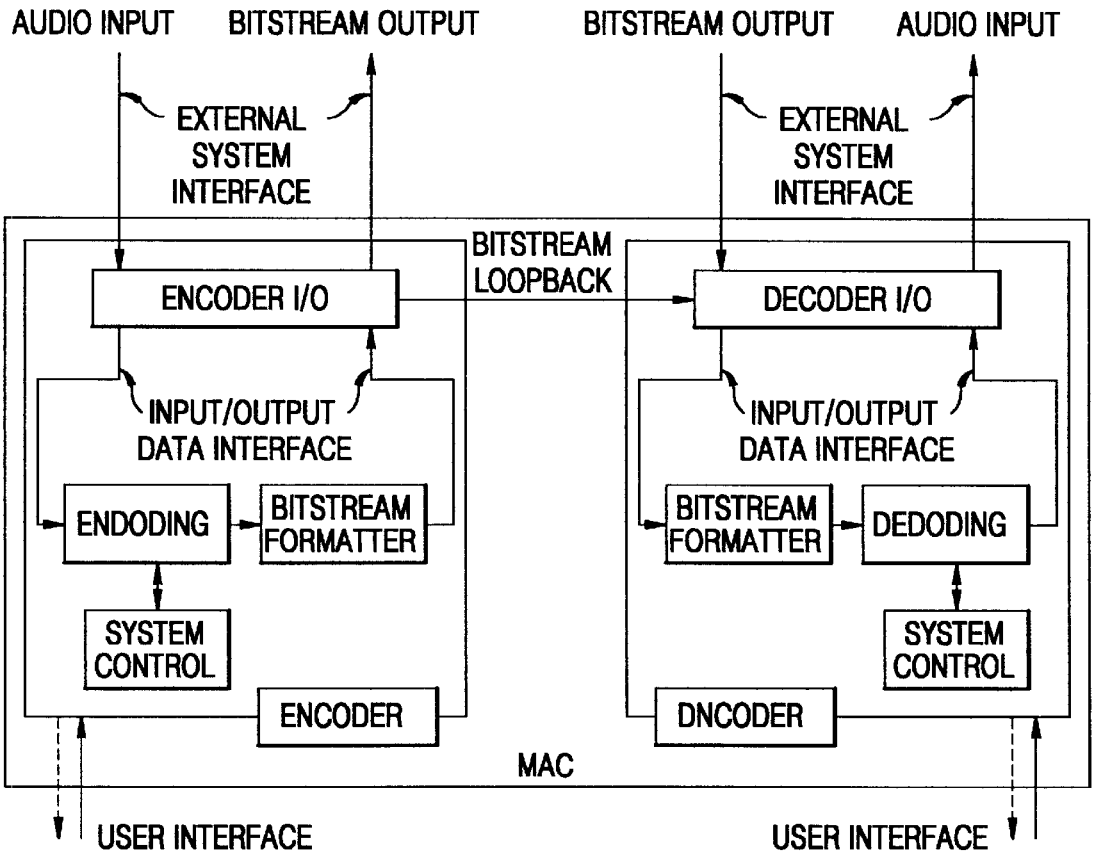
FIG. 5 shows as a CODEC illustrated in FIG. 1 for convenience.

FIG. 5 shows as a CODEC illustrated in FIG. 1. A multichannel audio CODEC (MAC) system has a target application of PC-based audio autoring tool, using a general purpose DSP board with a PCI interface. In order to meet target application functions of the MAC system and interfaces to external systems are depicted in FIG. 5. The MAC system consists of an encoder and a decoder.

In the MAC system, the encoder and decoder are implemented using the same hardware platform, DSP board of TMS320C6701[4][5], of Texas Instrument, using software configuration. The encoder can be connected to the decoder through a loopback path between the two.

The encoder has functions such as encoder input/output (I/O), encoding, bitstream formatter and encoding control. Similarly, the decoder has functions such as decoder I/O, bitstream parser, decoding and decoding control.

Figure 6:
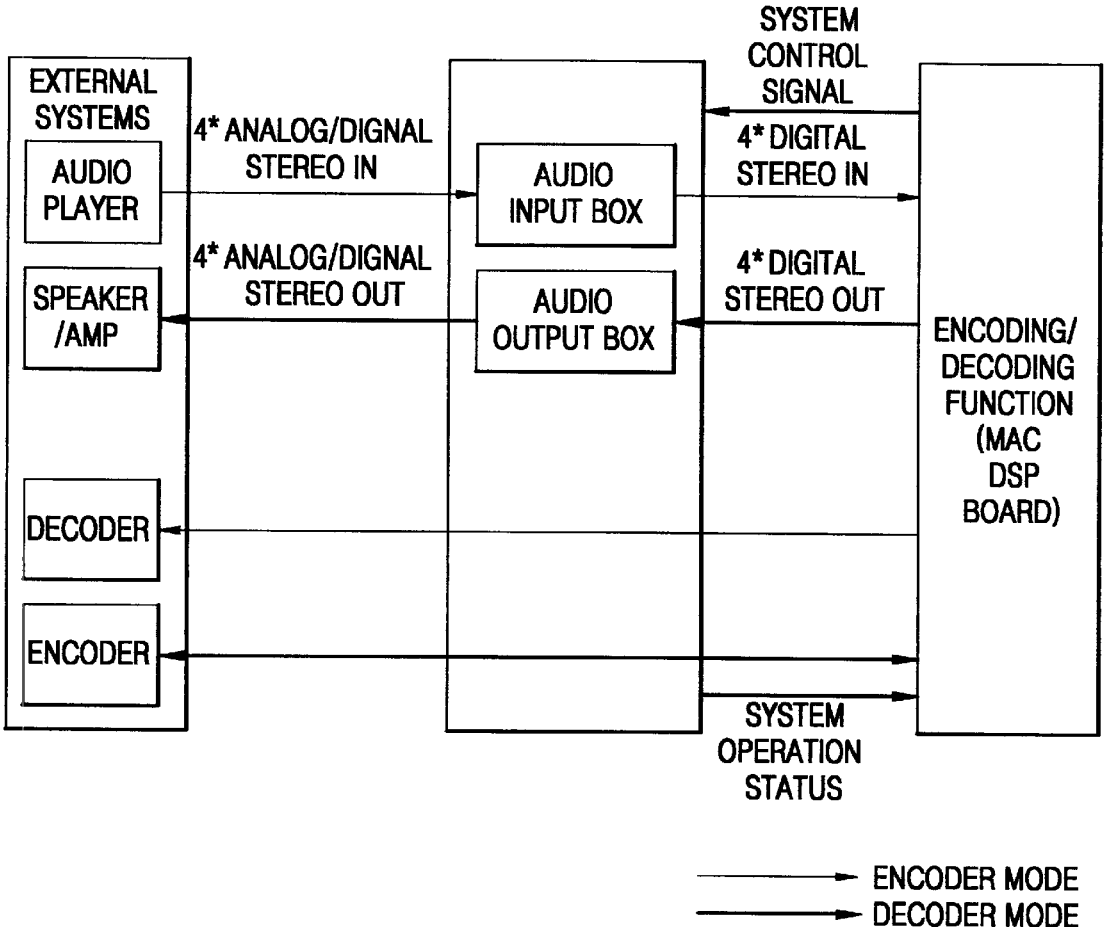
FIG. 6 shows an input/output function unit of the MAC system shown in FIG. 5.

FIG. 6 shows an input/output function unit of the MAC system shown in FIG. 5. In FIG. 6, the input/output data interface shown in FIG. 5 is depicted as I/O box. The input function unit of the system gets audio signals of analog or digital format from external systems including PC's hard disk driver (HDD) and then, transfers them to the encoding function unit via the input data interface in the form of digital data. And also, it bypasses bitstream data from external systems including PC's HDD and an encoding function unit of another MAC system, to the decoding function unit.

Conversely, the output function unit of the system receives decoded audio signals of digital format from the decoding function unit via the output data interface. Then, this unit sends them in the form of digital or analog data to external systems. And also, this unit bypasses encoded bitstream data from the encoding function unit to external systems.

Operation of the input/output function unit is devided into an audio I/O box and direct bitstream I/O paths.

For eight channel audio input, 4-ch inputs of AES-3 digital format and 8-ch inputs of balanced analog format ate provided.

For audio input, in case of an analog signal, sampling frequencies of 48 KHz, 44.1 KHz, and 32 KHz are provided depending on the bandwidth of that signal. A signal to noise ratio (SNR) is above 90 dB and a quantizer step size is represented using above 16 bits. For digital signals, the format of AES/EBU (Audio Engineering Society/European Broadcasting Union) is supported. The number of bits per sample in each stereo channel is up to 24.

For audio output, both analog and digital types of signals are also permitted and the number of channels is up to 8. The bandwidth is between 15 Hz and 20 KHz for a sampling frequency of 44.1 KHz or 48 KHz and dequantization is performed using up 24 bits. Output channels for 5.1 channels cosist of, that is, L/R, LS/RS, and C/SW. For a digital output, the format of S/PDIF (Sonry/Philips Digital Audio Interface Format) is supported.

For monitoring of each pair of audio channels, headphone output, level and balance adjustments, and selection switch of monitoring channel are provided. And for user interface, level indicators of each analog audio channel and sampling frequency and error indicators of digital audio input are provided.

The input/output function unit directly transmits encoded bitstream data in the form of elementary stream (ES), from the encoding function unit to external systems. External systems can be audio decoder, MUX, HDD of host PC, etc. When the MAC system, as an encoder, is interconnected to be directly transferred to the decoding function unit of another MAC system.

Similarly, this function unit bypasses bitstream data from external systems to the decoding function unit.

Figure 7:
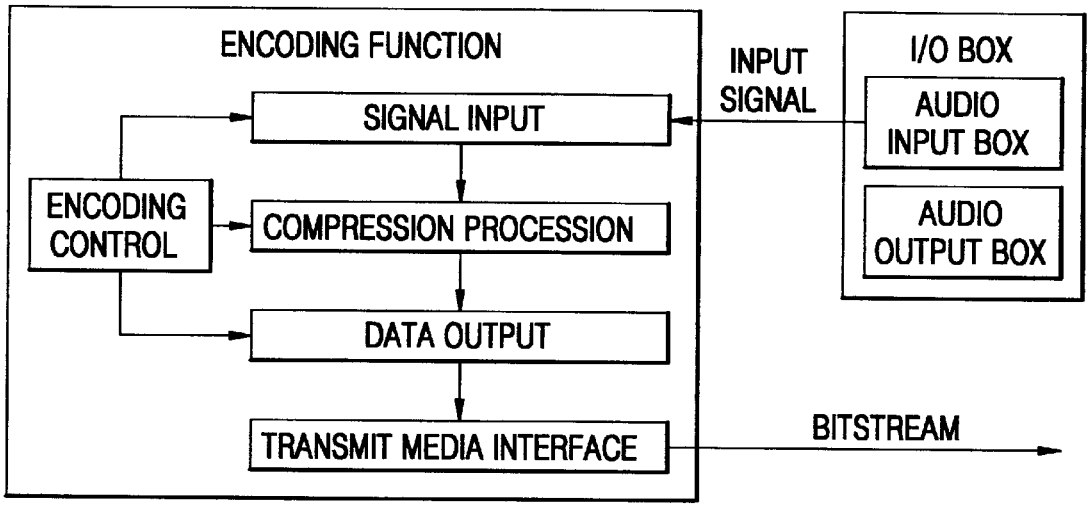
FIG. 7 shows an encoding function unit of the MAC system shown in FIG. 5.

FIG. 7 shows an encoding function unit of the MAC system shown in FIG. 5. The encoding function unit gets digital audio from the audio input box of the input/output function unit. Then, this unit compresses it using MPEG-2 AAC of LC profile. Finally, it transfers bitstream externally.

Operation of the encoding function unit is assigned into and performed at the following subunits: the signal input, compression processing, data output, encoding control, and transmit media interface subunits.

Signal input subunit performs data multiplexing and buffering. This receives data of up to 4 stereo-channels from the audio input box and transfers them in the compression processing subunit.

The input data must be transferred to the compression processing subunit in the uniform channel order. To do so, the input data are multiplexed according to the channel order under the control of the synchronized clock to the sampling frequency of the input signal. Control data necessary for signal inputting are synchronized to a clock generated by the data output subunit. A block of the multiplexed data is stored at a data buffer in order for a direct memory access (DMA) transfer in the unit of the block size.

Compression processing subunit is implemented using DSP for diverse applications and flexible improvement of the system performance. Two DSPs of TMS320C6701 are used for MPEG-2 MC software, one for psychoacoustic module and the other for quantization loop module. A first-in first-out (FIFO) of 16KHWord (Half Words) is used for data transfer between the two.

Data output subunit transfers the bitstream encoded by the compression processing subunit externally via the transmit media interface.

The data buffer is used to heap the bitstream at an external memory like FIFO memory before outputting the bitstream.

The heaping of the bitstream is performed by DMA and the data is transferred to the parallel-to-serial (P/S) conversion in the unit of a word (32-bits) with the uniform period.

The control signal needed for data output is generated at the clock generator using an external or internal clock. When the bitstream is outputted with synchronized to the internal clock, that clock signal can be transferred for synchronization with an external system.

The clock generator makes a clock using an internal and external clock as a clock source for audio input and bitstream output. The clock is generated using common multiples of the internal and external clocks by phase locked loop (PLL). The clock generator also creates several control signals for the bitstream output. These control signals include one for the data buffer output and input to the P/S conversion and one for the P/S conversion and bitstream output in this subunit. And also the clock generator provides a control signal for the data multiplexing and buffering of multichannel audio in the signal input subunit. Besides, control signals for the system and user interface can be generated by this clock generator.

Figure 8:
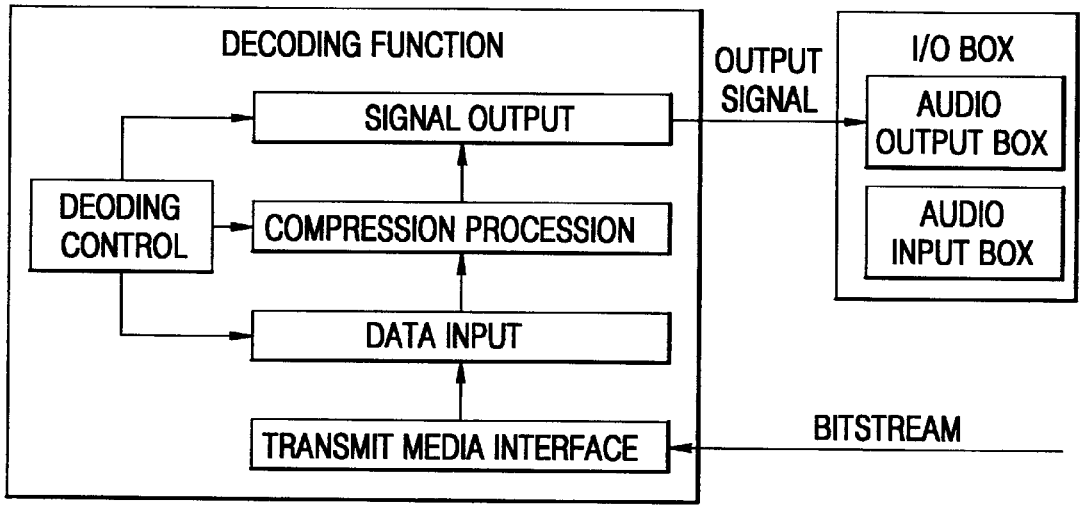
FIG. 8 shows a decoding function unit of the MAC system shown in FIG. 5.

FIG. 8 shows a decoding function unit of the MAC system shown in FIG. 5. The decoding function unit gets an external bitstream and then recovers the encoded bitstream using MPEG-2 MC of LC profile. Finally, it transfers the recovered digital to the audio output box.

Operation of the decoding function unit is assigned into and performed at the following subunits: the transmit media interface, data input, decompression processing, signal output, and decoding control subunits.

Data input subunit parses a bitstream and transfers it to the decompression processing subunit. This input bitstream is received with a clock to which it was synchronized at an encoder.

The serial input bitstream is converted into and outputted externally as a parallel data with the unit of word by the serial-to-paralle (S/P) conversion.

The control signal needed for the paralleled bitstream data output is generated at the clock generator using an internal clock if the bitstream to this subunit is not provided with a clock.

Besides, functions of displaying a status information of the system onto a host PC's monitor and alerting a user in case of a fault bitstream should be provided.

Decompression processing subunit is implemented using DSP for diverse applications and flexible improvement of the system performance like the compression processing subunit. Only one DSP of TMS320C6701 is used for MPEG-2 AAC software.

Signal output subunit performs data buffering and demultiplexing in the uniform channel order and defines the format of output signals. This receives data decoded by the decompression processing subunit and outputs data of up to 4 stereo-channels to the audio output box.

A block of received data is stored at a data buffer using a DMA transfer in the unit of the block size. The stored data are demultiplexed in the channel order under the control of the synchronized clock to the sampling frequency of the input signal. Control data necessary for signal outputting are synchronized to a clock generated by the data input subunit or an external clock.

Figure 9:
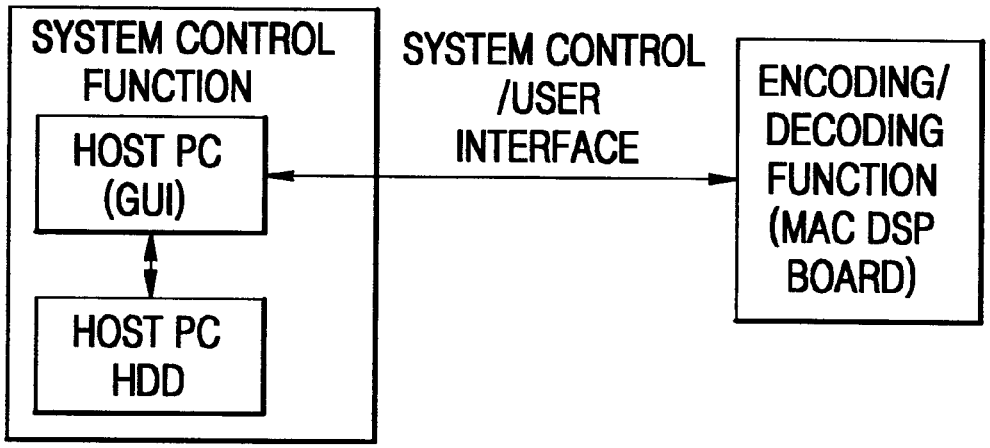
FIG. 9 shows a system control function unit of the MAC system shown in FIG. 5.

FIG. 9 shows a system control function unit of the MAC system shown in FIG. 5. The system control function unit performs the control and operation monitoring of the MAC system through the user interface and to do so. It provides interface to them. This function consists of the control of and interface to the encoding and decoding function units.

The system control function for the encoding function is implemented basically using the same method as that for decoding function.

The control of encoding/decoding function is performed by a host personal computer (PC) using a graphic user interface (GUI). And the hard disk driver (HDD) of the host PC is interfaced to the DSP by the peripheral connection interface (PCI) interface.

The system monitoring by the user interface is necessary to confirm a system control procedure, to feedback a system operation mode and to reflect a system fault operation. In the confirmation of the control procedure, the parameter set by the system user using the GUI is reflected on the monitor of the host PC. The system mode of operation is displayed on the monitor when the control of the system is completed. At initial state, a defined default mode is displayed.

As described above, the present invention not only has functions of externally inputting and outputting multichannel audio/speech and data but also communicates various data with storage media in a PC after coupled to the PC. The CODEC system of the present invention can also perform various multimedia processing functions by controlling the system with system control software, which executes load of the application programs via the PC storage media, communication of system control data and status information, and transmission of audio/speech and multimedia data. The CODEC system is provided with an acceleration function for compression and reconstruction of multichannel audio, speech, and multimedia data at high speed or in real time by employing an internal high performance DSP engine. Therefore, the present invention can be applied to various PC applications and used as a peripheral device of the PC for processing various multimedia data, thereby enhancing performance and efficiency of the present and future computers.

Additionally, the present invention can be applied for transmission of high quality audio/video on demand, video conference between multiple points, home shopping, and so on which are provided via the internet wherein usage fields of the present PC has been expanded.

It will be apparent to those skilled in the art that various modifications and variations can be made in a PC multichannel audio/speech and data CODEC system of the present invention without deviating from the spirit or scope of the invention. Thus, it is intended that the present invention cover the modifications and variations of this invention provided they come within the scope of the appended claims and their equivalents.

What is claimed is:

1. A data encoder/decoder (CODEC) system for use in a host computer to control signal processing operations, including encoding and decoding multichannel audio/speech and multimedia data, the data CODEC system comprising:

a system control software section arranged to communicate with one or more application programs stored in storage media of the host computer;

a signal processing section arranged to control signal processing operations, including encoding and decoding multichannel audio/speech and multimedia data under control of the system control software section; and an input-output section arranged to input multichannel audio/speech and multimedia data from an external system, and to output processed data to the external system;

wherein said system control software section communicates multichannel audio/speech and multimedia data with said signal processing section under control of said application programs; and wherein said signal processing section processes multichannel audio/speech and multimedia data using said application programs under control of said system control software section.

2. The data CODEC system according to claim 1, wherein said system control software section loads a signal processing program corresponding to a designated usage from said application programs stored in the storage media of the host computer onto said signal processing section, and executes said signal processing program to process multichannel audio/speech and multimedia data.

3. The data CODEC system according to claim 2, wherein said signal processing section includes a digital signal processor arranged to control signal processing operations using said signal processing program transferred by said system control software section.

4. The data CODEC system according to claim 3, wherein said digital signal processor receives multichannel audio/speech and compressed data of said multichannel audio/speech from said application programs, processes said multichannel audio/speech and said compressed data of said multichannel audio/speech, and transmits result data to a corresponding application program.

5. The data CODEC system according to claim 3, wherein said digital signal processor receives multichannel audio/speech and compressed data of said multichannel audio/speech from the external system via said input-output section, processes said multichannel audio/speech and said compressed data of said multichannel audio/speech, and outputs result data to the external system via said input-output section.

6. The data CODEC system according to claim 3, wherein said digital signal processor is implemented to perform the following functions:

receiving multichannel audio/speech and compressed data of said multichannel audio/speech from said application programs, processing said multichannel audio/speech and said compressed data of said multichannel audio/speech, and transmitting result data to a corresponding application program; and receiving said multichannel audio/speech and said compressed data of said multichannel audio/speech from the external system via said input-output section, processing said multichannel audio/speech and said compressed data of said multichannel audio/speech, and outputting said result data to the external system via said input-output section.

7. The data CODEC system according to claim 6, wherein said input-output section comprises:

a multichannel audio/speech input unit for inputting said multichannel audio/speech from the external system under control of the application program;

a multichannel audio/speech output unit for outputting said multichannel audio/speech to the external system under control of the application program;

a data input unit for inputting compressed, encoded data as digital signals from the external system via a serial interface; and a data output unit for outputting compressed, encoded data as digital signals to the external system via said serial interface.

8. The data CODEC system according to claim 2, wherein said signal processing section comprises:

a host interface for communicating with said system control software section;

a signal processing module for compressing multichannel audio/speech, reconstructing multichannel audio/speech, compressing multimedia data, reconstructing multimedia data, and processing sound effects; and a data interface for outputting data processed by said signal processing module to the external system, via said input-output section, and for inputting data to be processed by said signal processing module from the external system, via said input-output section.

9. The CODEC system according to claim 8, wherein said signal processing module is implemented by a general purpose digital signal processor including multichannel audio/speech compressing means, multichannel audio/speech reconstructing means, and other data processing means for multimedia data compression, multimedia data reconstruction, and sound effect processing.

10. The data CODEC system according to claim 2, wherein said input-output section comprises:

a multichannel audio/speech input unit for inputting said multichannel audio/speech from the external system under control of the application program;

a multichannel audio/speech output unit for outputting said multichannel audio/speech to the external system under control of the application program;

a data input unit for inputting compressed, encoded data as digital signals from the external system via a serial interface; and a data output unit for outputting compressed, encoded data as digital signals to the external system via said serial interface.

11. The data CODEC system according to claim 2, wherein said signal processing section comprises:

a host interface for communicating with said system control software section;

a signal processing module for compressing multichannel audio/speech, reconstructing multichannel audio/speech, compressing multimedia data, reconstructing multimedia data, and processing sound effects; and a data interface for outputting data processed by said signal processing module to the external system via said input-output section, and for inputting data to be processed by said signal processing module from the external system via said input-output section.

12. The data CODEC system according to claim 1, wherein said input-output section comprises:

a multichannel audio/speech input unit for inputting said multichannel audio/speech from the external system under control of the application program;

a multichannel audio/speech output unit for outputting said multichannel audio/speech to the external system under control of the application program;

a data input unit for inputting compressed, encoded data as digital signals from the external system via a serial interface; and a data output unit for outputting compressed, encoded data as digital signals to the external system via said serial interface.

13. The data CODEC system according to claim 12, wherein said signal processing section comprises:

a host interface for communicating with said system control software section;

a signal processing module for compressing multichannel audio/speech, reconstructing multichannel audio/ speech, compressing multimedia data, reconstructing multimedia data, and processing sound effects; and a data interface for outputting data processed by said signal processing module to the external system via said input-output section, and for inputting data to be processed by said signal processing module from the external system via said input-output section.

14. The data CODEC system according to claim 1, wherein said signal processing section comprises:

a host interface for communicating with said system control software section;

a signal processing module for compressing multichannel audio/speech, reconstructing multichannel audio/speech, compressing multimedia data, reconstructing multimedia data, and processing sound effects; and a data interface for outputting data processed by said signal processing module to the external system via said input-output section, and for inputting data to be processed by said signal processing module from the external system via said input-output section.

15. The CODEC system according to claim 14, wherein said signal processing module is implemented by a general purpose digital signal processor including multichannel audio/speech compressing means, multichannel audio/speech reconstructing means, and other data processing means for multimedia data compression, multimedia data reconstruction, and sound effect processing.

16. A data encoder/decoder (CODEC) system installed in a host computer, comprising:

a system control software section arranged to communicate with one or more application programs stored in storage media of the host computer;

an input-output section arranged to receive data from an external device, and to output processed data to the external device; and a signal processing section arranged to receive data from one of an application program and the external device, via the input-output section; to control signal processing operations, including data encoding and data decoding in accordance with the application program; and to transmit processed data to the application program for storage in the storage media or to the external device, via the input-output section, wherein the system control software section loads the application program from the storage media, activates operations of the signal processing section and the input-output section, generates system status information to the application program, and transmits data stored in the storage media to the signal processing section and processed data from the signal processing section to the application program for storage in the storage media.

17. The data CODEC system according to claim 16, wherein the data received from one of the storage media and the external device indicates multimedia data or multichannel audio data.

18. The data CODEC system according to claim 17, wherein the signal processing section comprises:

a host interface arranged to interface with the system control software section;

a signal processing module arranged to perform data compression, data reconstruction and other signal processing operations; and a data interface arranged to interface with the input-output section, to output processed data from the signal processing module to the external device, via the input-output section, and to receive data to be processed by the signal processing module from the external system, via the input-output section.

19. The CODEC system according to claim 18, wherein the signal processing module is a general purpose digital signal processor implemented to perform multichannel audio/speech compression, multichannel audio/speech reconstruction, multimedia data compression, multimedia data reconstruction, and sound effect processing operations.

20. The data CODEC system according to claim 17, wherein the input-output section comprises:

a multichannel audio/speech input unit arranged to receive multichannel audio/speech from the external system in accordance with the application program;

a multichannel audio/speech output unit arranged to output the multichannel audio/speech to the external system in accordance with the application program;

a data input unit arranged to receive compressed, encoded multimedia data from the external system via a serial interface; and a data output unit arranged to output compressed, encoded multimedia data to the external system via said serial interface.

* * * * *